US008312848B2

(12) United States Patent
Weed

(10) Patent No.: US 8,312,848 B2
(45) Date of Patent: Nov. 20, 2012

(54) ENGINE BLOCK ASSEMBLY FOR INTERNAL COMBUSTION ENGINE

(75) Inventor: Dean Lee Weed, Waterford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 449 days.

(21) Appl. No.: 12/717,242

(22) Filed: Mar. 4, 2010

(65) Prior Publication Data

US 2011/0214630 A1 Sep. 8, 2011

(51) Int. Cl.
*F02F 1/14* (2006.01)

(52) U.S. Cl. ..... 123/41.79; 123/41.72; 123/41.78

(58) Field of Classification Search ..... 123/41.79, 123/41.78, 41.72
See application file for complete search history.

(56) References Cited

U.S. PATENT DOCUMENTS

| | | | | |
|---|---|---|---|---|
| 5,188,071 | A * | 2/1993 | Han | 123/195 R |
| 6,481,392 | B1 * | 11/2002 | Etemad | 123/41.74 |
| 6,581,550 | B2 * | 6/2003 | Shinpo et al. | 123/41.74 |
| 6,834,625 | B2 * | 12/2004 | Matsutani et al. | 123/41.79 |
| 6,874,451 | B2 * | 4/2005 | Matsutani et al. | 123/41.79 |
| 7,216,611 | B2 * | 5/2007 | Matsutani et al. | 123/41.72 |
| 7,798,108 | B2 * | 9/2010 | Konishi et al. | 123/41.79 |
| 2002/0000210 | A1 * | 1/2002 | Shinpo et al. | 123/41.74 |
| 2005/0211196 | A1 * | 9/2005 | Matsutani et al. | 123/41.15 |

FOREIGN PATENT DOCUMENTS

| | | | |
|---|---|---|---|
| JP | 2005030297 | A * | 2/2005 |
| JP | 2006090193 | A * | 4/2006 |

* cited by examiner

*Primary Examiner* — Noah Kamen
*Assistant Examiner* — Hung Q Nguyen
(74) *Attorney, Agent, or Firm* — Cantor Colburn LLP

(57) ABSTRACT

An engine block assembly for an internal combustion engine comprises a cylinder portion having a plurality of cylinder walls disposed therein. A water jacket, having opposed side walls, extends about the plurality of cylinder walls to define a coolant flow path. A coolant inlet in fluid communication with the water jacket delivers coolant thereto and a coolant outlet in fluid communication with the water jacket removes coolant therefrom. Opposed sealing shoulders extend into the coolant flow path from the water jacket side walls and a longitudinally extending coolant baffle is disposed in the water jacket adjacent to the sealing shoulders. The coolant baffle includes a baffle sealing face configured to engage the opposed sealing shoulders to direct the coolant entering the water jacket in a single direction around the cylinder walls of the cylinder portion.

19 Claims, 6 Drawing Sheets

ENGINE BLOCK ASSEMBLY FOR INTERNAL COMBUSTION ENGINE

FIELD OF THE INVENTION

Exemplary embodiments of the present invention relate to engine block assemblies for internal combustion engines and, more particularly, to an engine block and baffle assembly for directing coolant flow.

BACKGROUND

A typical engine block for a reciprocating piston, internal combustion engine comprises two general portions; the crankcase portion and the cylinder portion. The crankcase portion is generally configured as a cavity that is configured to support a rotating crankshaft while the cylinder portion includes cylinder walls that are generally surrounded by a water jacket through which engine coolant is circulated under pressure for the purpose of removing excess heat therefrom. Once the engine coolant is circulated through the cylinder water jacket it may be diverted to another portion of the internal combustion engine, such as the cylinder head, to remove additional excess heat or it may be pumped to a heat exchanger where heat is removed from the coolant prior to being returned to the engine.

An important consideration in the design of the cylinder portion of the engine block is the efficient distribution and flow of the coolant for maximum effectiveness as well as for the avoidance of thermal inconsistencies that may induce warping or deflection of the block or cylinder head causing damage to, or poor performance of, the internal combustion engine. Coolant entering the water jacket from an external source requires careful flow direction to assure that it fully circulates through and around the cylinder portion.

SUMMARY OF THE INVENTION

In an exemplary embodiment an engine block assembly for an internal combustion engine comprises a cylinder portion having a plurality of cylinder walls disposed therein. A water jacket, having opposed side walls, extends about the plurality of cylinder walls to define a coolant flow path A coolant inlet in fluid communication with the water jacket delivers coolant thereto and a coolant outlet in fluid communication with the water jacket removes coolant from the water jacket. Opposed sealing shoulders extend into the coolant flow path of the water jacket from the water jacket side walls and a longitudinally extending coolant baffle is disposed in the water jacket adjacent to the sealing shoulders. The coolant baffle includes a baffle sealing face configured to engage the opposed sealing shoulders to direct the coolant entering the water jacket.

In another exemplary embodiment, an engine block assembly for an internal combustion engine comprises a closed deck cylinder portion having a plurality of cylinder walls disposed therein. A water jacket, having opposed side walls, extends about the plurality of cylinder walls to define a coolant flow path thereabout. A coolant inlet in fluid communication with the water jacket delivers coolant thereto and a coolant outlet in fluid communication with the water jacket removes coolant from the water jacket. Opposed sealing shoulders extend into the coolant flow path of the water jacket from the water jacket side walls; the cooling shoulders extending the height of the water jacket. An opening extends through the closed deck cylinder portion adjacent to the opposed sealing shoulders. A longitudinally extending coolant baffle is inserted into the water jacket through the opening in the closed cylinder deck portion, and has a baffle sealing face having sealing surfaces configured to engage the opposed sealing shoulders to define a face seal therebetween and to close a portion of the water jacket against coolant flow and direct the coolant entering the water jacket through the coolant inlet.

The above features and advantages, and other features and advantages of the present invention are readily apparent from the following detailed description of the best modes for carrying out the invention when taken in connection with the accompanying drawings.

BRIEF DESCRIPTION OF THE DRAWINGS

Other objects, features, advantages and details appear, by way of example only, in the following detailed description of the embodiments, the detailed description referring to the drawings in which.

DESCRIPTION OF THE EMBODIMENTS

Figure 1:
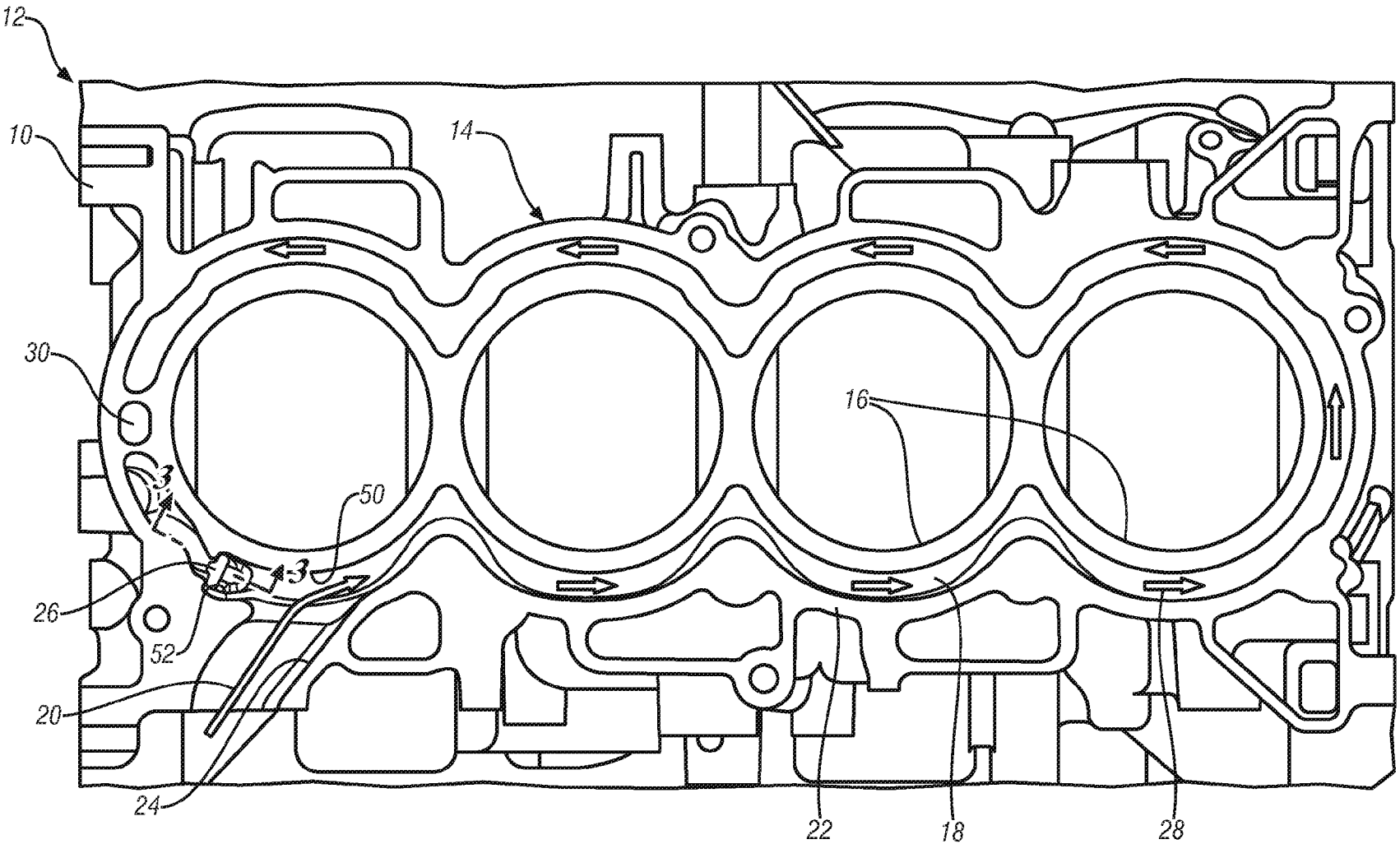
FIG. 1 is a sectional plan view taken through the cylinder portion of an inline 4-cylinder internal combustion engine embodying features of the present invention.

The following description is merely exemplary in nature and is not intended to limit the present disclosure, application or uses. It should be understood that throughout the drawings, corresponding reference numerals indicate like or corresponding parts and features.

Referring to FIG. 1, in an exemplary embodiment, an engine block 10 of a 4-cylinder, in-line, reciprocating internal combustion engine 12 is shown. It is understood that the specific configuration of the engine (i.e. 4-cylinder, in-line) is for illustration only and that the invention may be equally applied to other configurations (ex. v-configured, horizontally opposed) of engine having numerous (2, 3, 4, 5, 6, 8, etc) options with respect to the number of pistons. The portion of the cylinder block 10 that is illustrated in FIG. 1 is the upper or cylinder portion 14 and includes a plurality of cylinder walls 16 that are each configured to receive a piston (not shown) for reciprocation therein. The cylinder walls 16 are surrounded by a water jacket 18 through which a cooling medium such as engine coolant 20 is circulated for the removal of excess heat from the cylinder walls 16 during the operation of the internal combustion engine 12. The water jacket 18 is enclosed by the outer wall 22 of the engine block 10 defining a closed cooling system that may be pressurized.

A coolant inlet 24 extends through the outer wall 22 of the engine block 10 and is in fluid communication with the water jacket 18 for delivery of coolant 20 from a pressurized source, such as a water pump (not shown). Upon entry into the water jacket 18 the coolant 20 is diverted or directed in a predetermined direction by a coolant baffle 26 that is disposed in the water jacket proximate to the coolant inlet 24. The coolant baffle 26 operates to block the flow of engine coolant 20 by sealingly closing the water jacket 18 resulting in direction of the coolant flow (substantially U-shaped in the embodiment shown) around the cylinder walls 16 as illustrated by the flow arrows 28. Upon completion of the flow circuit defined by the water jacket 18, the coolant 20 may exit the water jacket through coolant outlet 30. The coolant outlet 30 may be in fluid communication with a cylinder head (not shown) and the engine coolant is subsequently circulated therethrough for removal of additional heat therefrom. As a result of the directed flow of coolant through the water jacket 18, cooling efficiency is improved over a similar system without directed flow of the coolant (about 55% of total coolant volume passing through the cylinder head exits through outlet 30 with about 45% exiting through other passages (not shown) at the head gasket to cylinder head interface).

Figure 2:
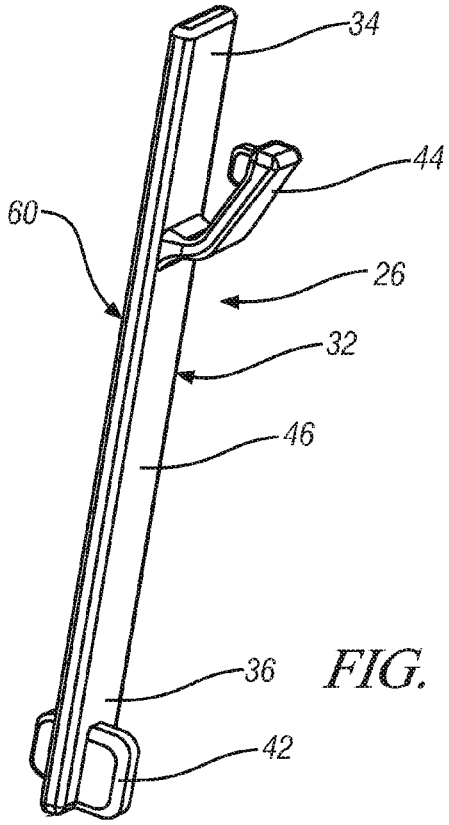
FIG. 2 illustrates a coolant baffle for application to the internal combustion engine of FIG. 1.
Figure 3:
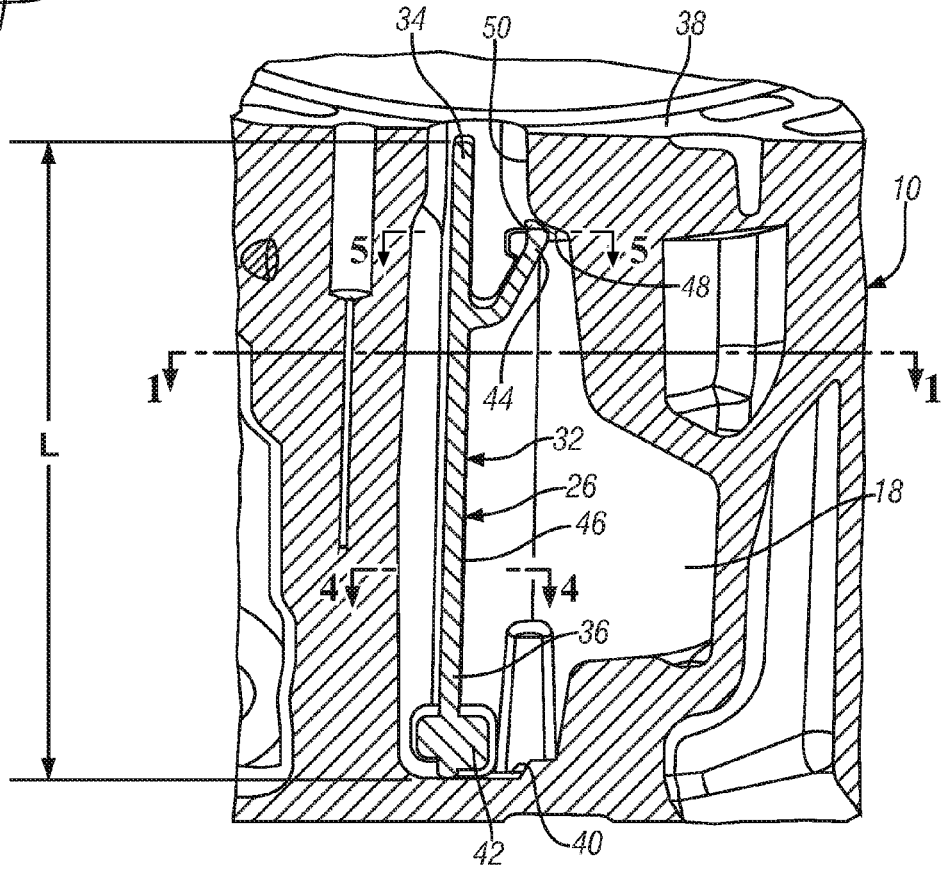
FIG. 3 is a sectional view taken through the internal combustion engine of FIG. 1 along section line 3-3.

Referring to FIG. 2, in an exemplary embodiment, the coolant baffle 26 comprises a longitudinally extending seal body 32 having a first, upper end 34 and a second, lower end 36 (upper and lower relating to the relative positions when inserted in the water jacket 18 of the engine block 10). The longitudinally extending sealing body has a length "L" that is substantially equal to the depth of the water jacket 18 at its position of installation, FIG. 3, such that the first, upper end 34 terminates closely adjacent to the deck 38 of the cylinder portion 14 of the engine block 10 and the second, lower end 36 rests against the bottom, closed end 40 of the water jacket 18. In an exemplary embodiment, the second, lower end of the coolant baffle 26 may include a positioning foot 42 that may be effective in locating and stabilizing the baffle against movement when inserted into the engine block 10. In another exemplary embodiment, a flexible retaining member 44 may extend outwardly from a side 46 of the longitudinally extending seal body 32 and operates to engage an under-portion or lip 48 of the engine block deck 38 following the installation of the coolant baffle into the water jacket 18 to thereby limit the possibility that the coolant baffle 26 can become dislodged during movement of the engine block 10 and subsequent assembly of the internal combustion engine 12. The flexible retaining member 44 is compressed against the longitudinally extending sealing body 32 during installation of the coolant baffle 26 through the deck opening 50, FIGS. 7 and 8, and is allowed to snap into position against the under portion 48 of the engine block deck 38 once installed in the engine block 10 providing a positive indication to the installer that the longitudinally extending sealing body 32 is properly installed therein. Additionally, in certain installations such as that illustrated in FIGS. 3 and 8, the flexible retaining member 44 exerts a biasing force against the under portion 48 of the engine block deck 38 and, as a result, urges the longitudinally extending seal body 32 into sealing engagement with the sealing shoulders 56, 58, FIGS. 4 and 5, of the cylinder block water jacket 18.

Figure 4:
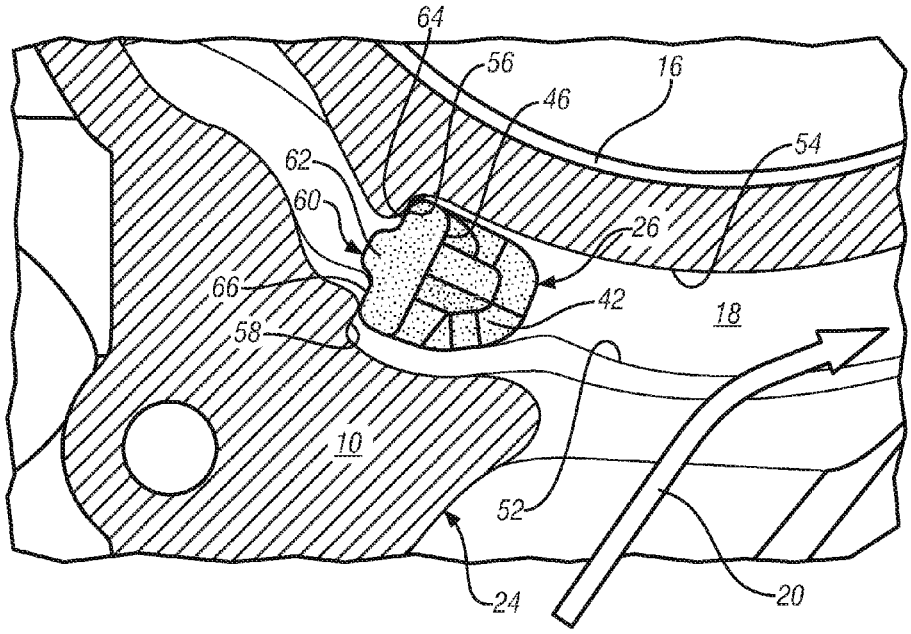
FIG. 4 is a sectional view taken through the internal combustion engine of FIG. 1 along section line 4-4 of FIG. 3.
Figure 5:
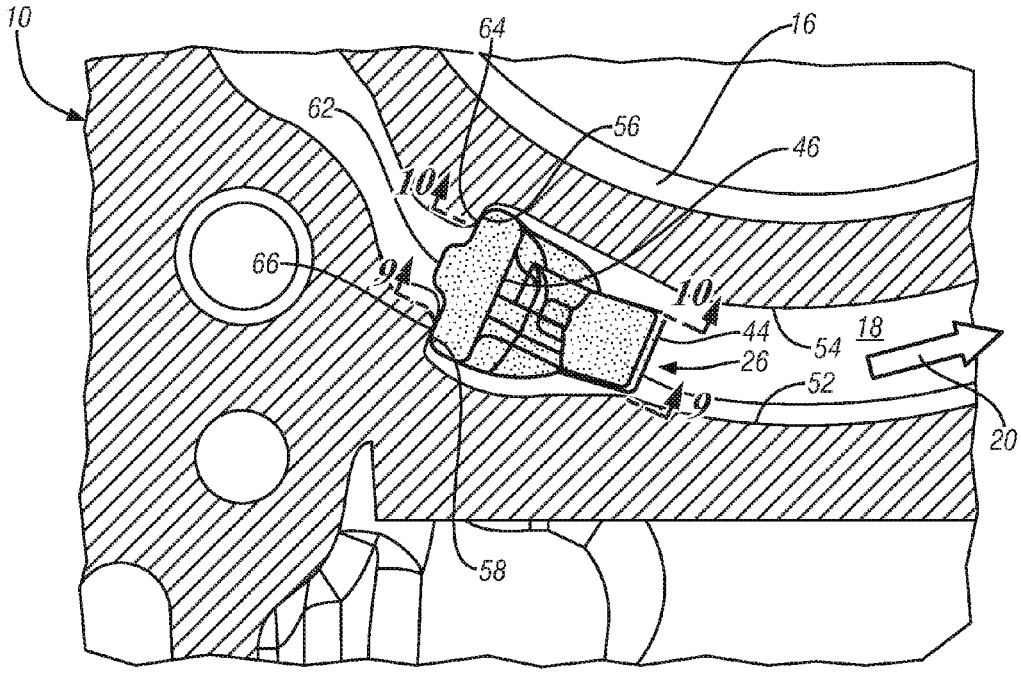
FIG. 5 is a sectional view taken through the internal combustion engine of FIG. 1 along section line 5-5 of FIG. 3.

Referring to FIGS. 3-6, the cylinder block 10 is a closed deck design that is preferably cast using a method such as sand or lost foam casting. A closed block design is one in which the upper surface or deck 38 extends across, or closes portions of the water jacket 18 thereby limiting full access to the water jacket from the engine block deck 38. Various openings in the engine block deck 38 define passages into the water jacket 18 and it is through one of these openings 50 that the coolant baffle may be inserted into the water jacket. Due to the nature of the casting process, the side walls 52 and 54 of the water jacket 18 may not extend in parallel to one another and, as such, the coolant baffle 26 is not configured for edge sealing with the side walls 52, 54. As illustrated in FIGS. 4 and 5, in an exemplary embodiment, the walls 52 and 54 define opposing sealing shoulders 56 and 58 that extend into the cooling flow path of the water jacket 18 from the top to the bottom thereof, and are configured to sealingly engage the rear, sealing face or surface 60 of the coolant baffle 26 in a face seal when the coolant baffle is inserted into the water jacket 18 through the opening 50 in the engine block deck 38. In one exemplary embodiment, a positioning rib 62 may extend longitudinally along the baffle sealing face 60 of the coolant baffle 26. The positioning rib 62 has a width that is slightly smaller than the width of the water jacket 18 between the sealing shoulders 56 and 58. The positioning rib 62 extends between the sealing shoulders 56, 58 of the water jacket side walls 52, 54 to assist in locating the sealing surfaces or wings 64 and 66 of the sealing face 60 into a face sealing engagement with the sealing shoulders 56, 58. During operation of the internal combustion engine 12, a pressure differential may exist between the front side 46 and the rear sealing face 60 of the coolant baffle 26 due to pressure loss in the flow of the engine coolant 20 between coolant inlet 24 (front side 46 of coolant baffle 26) and the coolant outlet 30 (rear sealing face 60 of coolant baffle 26). The pressure differential across the coolant baffle 26 will aid in assuring an adequate seal between the water jacket sealing shoulders 56, 58 and the sealing surfaces 64, 66 of the coolant baffle 26.

The configuration of the sealing shoulders 56, 58 of the engine block water jacket 18 and the rear baffle sealing face 60 of the coolant baffle 26 provides for establishment of a relatively passive seal against the flow of engine coolant 20 therebetween. As a result, the coolant baffle 26 may be constructed as a relatively inexpensive component that may not require an internal support for rigidity that may be required in the case of an edge sealing baffle. The coolant baffle 26 may be constructed of a suitable heat resistant composite, a flexible rubberized material or a combination thereof, having properties that promote good sealing conformity between the baffle sealing surfaces 64, 66 and the water jacket sealing shoulders 56, 58. Additionally, the sealing configuration of the engine block water jacket 18 with the coolant baffle 26 addresses the difficulty of sealing between the opposing water jacket side walls 52, 54 which may not be parallel due to draft angles that are inherent in the type of casting process used to produce a closed block design of the type illustrated herein.

Figure 9:
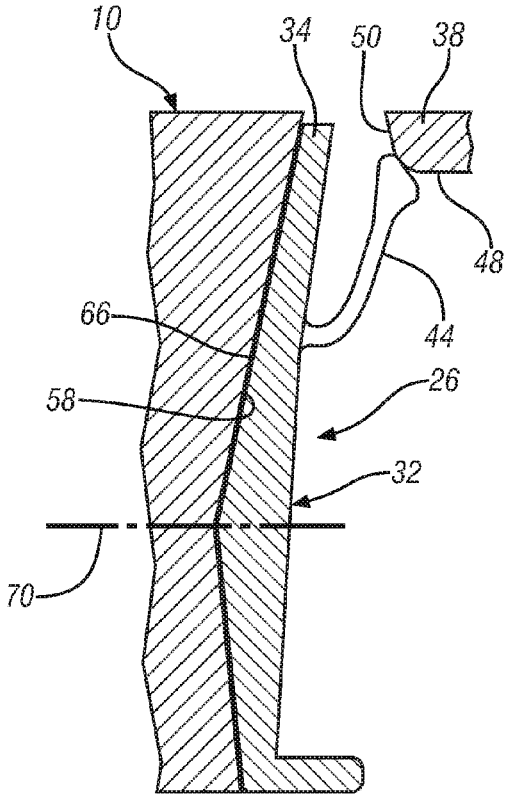
FIG. 9 is a sectional view taken through the internal combustion engine of FIG. 1 taken along line 10-10 of FIG. 5.
Figure 11:
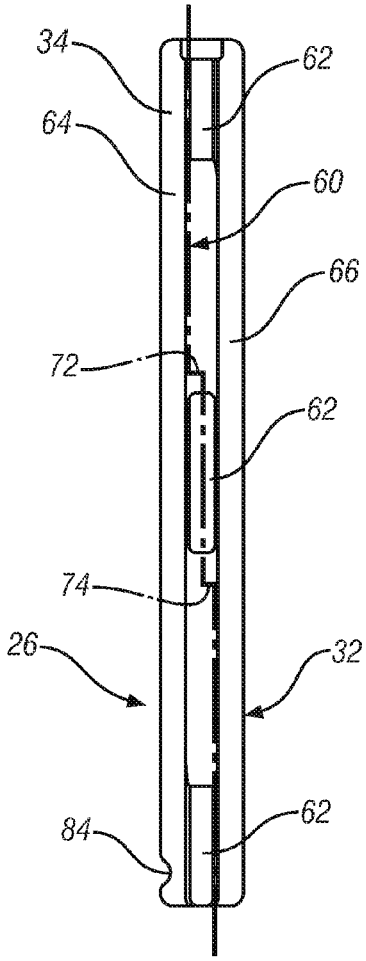
FIG. 11 is a rear view of the coolant baffle of FIGS. 6 and 7.
Figure 10:
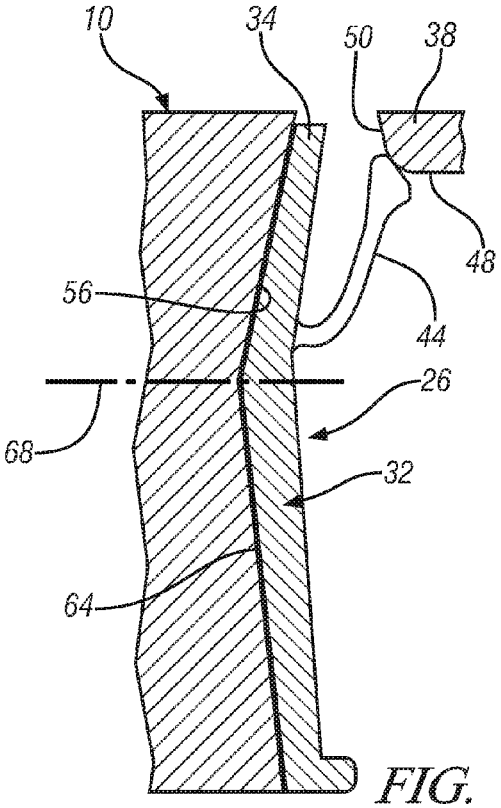
FIG. 10 is a sectional view taken through the internal combustion engine of FIG. 1 taken along line 11-11 of FIG. 5.

In an exemplary embodiment illustrated in FIGS. 9-11, the longitudinally extending seal body 32 may be molded in a manner that allows each sealing shoulder 64, 66 to be independently configured to match the contours of the water jacket side sealing shoulders 56, 58 on either side of the water jacket 18. As can be seen in FIGS. 9 and 10, the contours of the water jacket side sealing shoulders 56, 58 may vary significantly due to different locations of the parting lines 68, 70 left by the water jacket core (not shown) during casting of the engine block 10. By integrating inflection points 72 and 74, FIG. 11, into the mold for the longitudinally extending seal body 32, each sealing surface 64, 66 may enjoy a different profile that is defined to provide an adequate seal with each sealing shoulder 56, 58.

Figure 6:
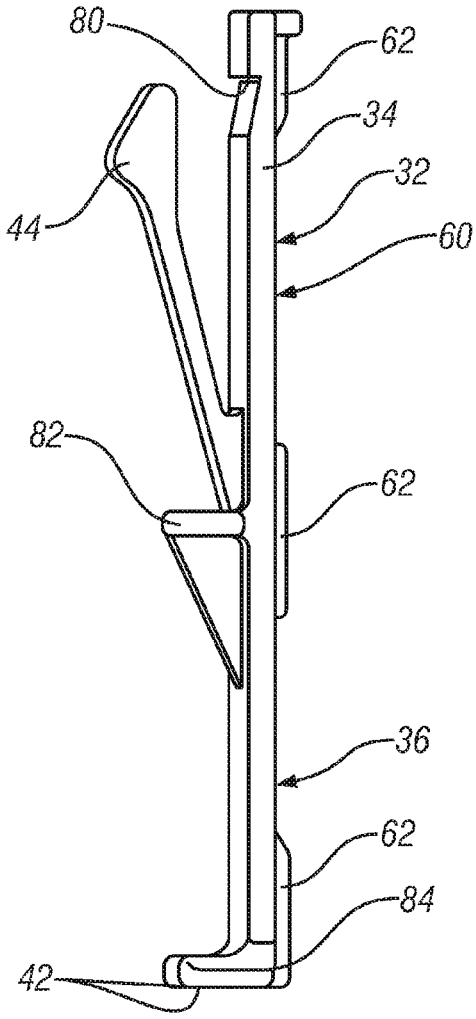
FIG. 6 illustrates a side view of another embodiment of a coolant baffle for application to the internal combustion engine of FIG. 1.
Figure 7:
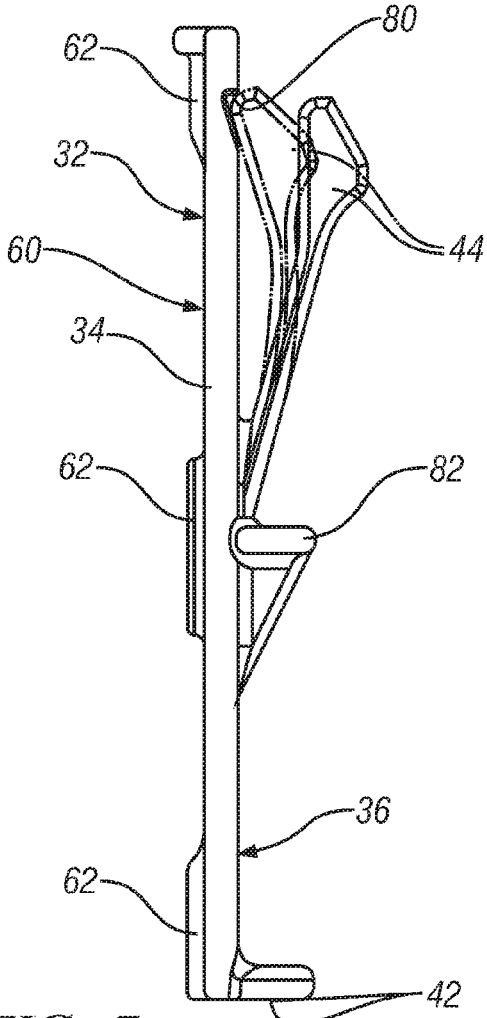
FIG. 7 illustrates another side view of the coolant baffle of FIG. 6.
Figure 8:
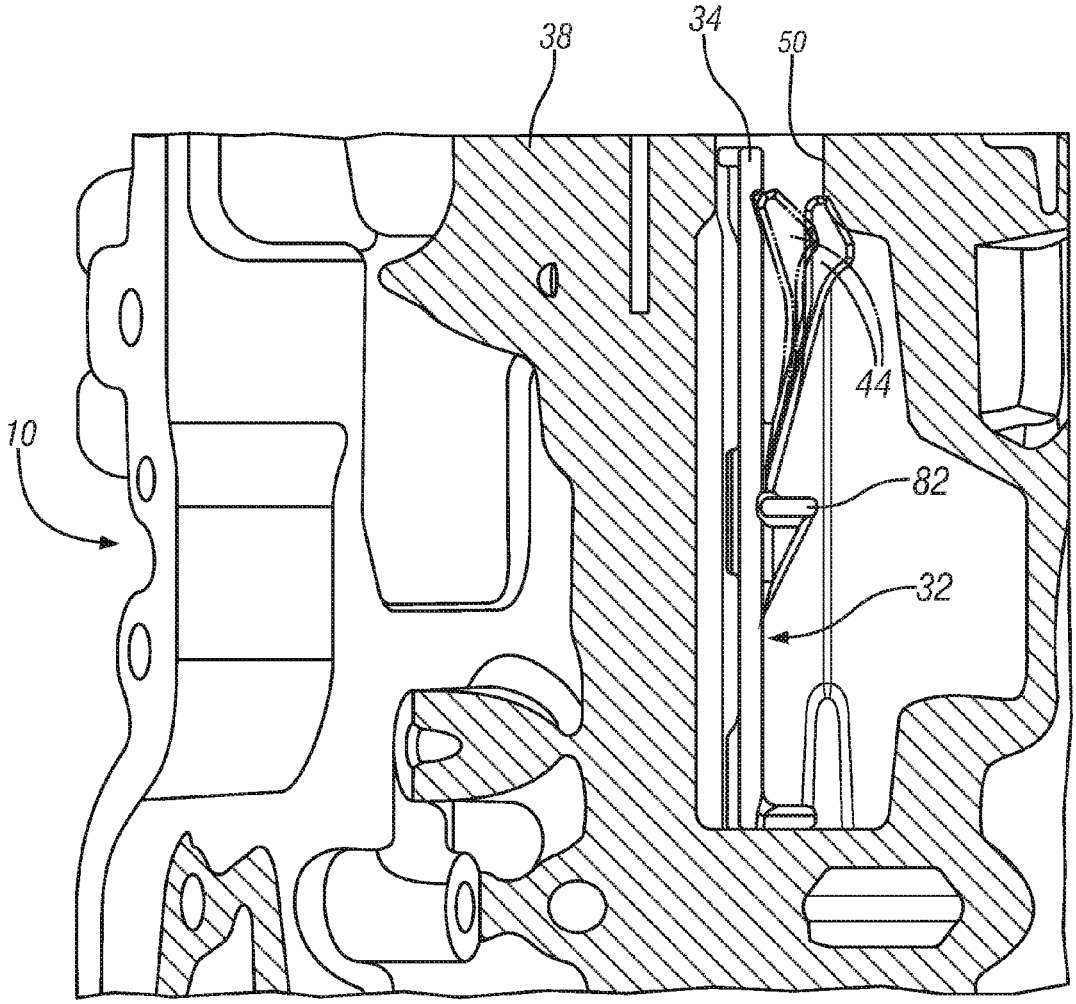
FIG. 8 another sectional view taken through the internal combustion engine of FIG. 1 along section line 3-3.

Referring now to FIGS. 6-8, in another exemplary embodiment, the longitudinally extending sealing body 32 may include a clearance feature 80 that is configured to receive a portion of the flexible retaining member 44 when compressed to provide additional clearance when being inserted into the deck opening 50 thereby aiding in the assembly of the coolant baffle 26 into the engine cylinder block 10. In some installations, the positioning rib 62, disposed on the rear baffle sealing face 60, may be segmented or discontinuous FIGS. 6-8, and 11 in order to reduce the longitudinal stiffness of the coolant baffle 26 to thereby improve conformability of the sealing surfaces 64 66 for better sealing against water jacket sealing shoulders 56 and 58. In an exemplary embodiment, a positioning shelf 82 may be located intermediate of the first end 34 and the second end 36 of the longitudinally extending seal body 32. The positioning shelf 82 cooperates with the positioning foot 42 to locate and stabilize the coolant baffle 26 against movement, particularly laterally, when inserted into the engine block 10. In yet another exemplary embodiment, a scallop 84 FIGS. 6 and 11, extends from the front side 46 to the rear baffle face 60 to define, when the coolant baffle 26 is installed in the water jacket 18 of the engine block 10, a coolant passage for the flow of engine coolant 20 therethrough. The scallop 84 allows "leakage" of coolant 20 past the coolant baffle 26 to thereby prevent the possibility of a hot spot on the wall of the water jacket 18 where, for instance, the positioning foot 42 seals. Similar scallops 84 may be located at other axial locations along the longitudinally extending seal body 32.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiments disclosed as the best mode contemplated for carrying out this invention, but that the invention will include all embodiments falling within the scope of the present application.

What is claimed is:

1. An engine block assembly for an internal combustion engine comprising:

a cylinder portion having a plurality of cylinder walls disposed therein;

a water jacket, having opposed side walls, extending about the plurality of cylinder walls to define a coolant flow path;

a coolant inlet in fluid communication with the water jacket for delivery of coolant thereto;

a coolant outlet in fluid communication with the water jacket for removal of coolant from the water jacket;

opposed sealing shoulders extending into the coolant flow path of the water jacket from the water jacket side walls, the sealing shoulders extending substantially the height of the water jacket; and a coolant baffle, having a longitudinally extending seal body, disposed in the water jacket adjacent to the sealing shoulders, the coolant baffle having a baffle sealing face configured to engage the opposed sealing shoulders and to direct the coolant, entering the water jacket through the coolant inlet.

2. The engine block assembly for an internal combustion engine of claim 1, the longitudinally extending coolant baffle extending substantially the height of the water jacket.

3. The engine block assembly for an internal combustion engine of claim 1, the longitudinally extending coolant baffle further comprising a longitudinally extending positioning rib extending from the baffle sealing face between the opposed sealing shoulders of the water jacket side walls to locate the sealing surface in sealing engagement with the opposed sealing shoulders of the water jacket.

4. The engine block assembly for an internal combustion engine of claim 3, wherein the longitudinally extending positioning rib is segmented to reduce the longitudinal stiffness of the coolant baffle and improve conformability of the baffle sealing face against opposed sealing shoulders.

5. The engine block assembly for an internal combustion engine of claim 1, wherein the engine block is a closed deck design having an opening extending into the water jacket proximate the opposed sealing shoulders and through which the coolant baffle is inserted into the water jacket.

6. The engine block assembly for an internal combustion engine of claim 5, the coolant baffle further comprising a flexible retaining member disposed at an upper end thereof and extending outwardly therefrom and wherein the flexible retaining member is configured for compression against the longitudinally extending seal body for insertion of the coolant baffle into the opening and engages an under-portion or lip of the engine block deck following insertion into the water jacket.

7. The engine block assembly for an internal combustion engine of claim 6, wherein the flexible retaining member exerts a biasing force against the under portion or lip of the engine block deck to urge the longitudinally extending seal body into sealing engagement with the sealing shoulders of the cylinder head water jacket.

8. The engine block assembly for an internal combustion engine of claim 6, the coolant baffle further comprising a clearance feature formed in the longitudinally extending seal body and configured to receive a portion of the flexible retaining member to allow an additional degree of clearance when being inserted into the deck opening of the engine cylinder block.

9. The engine block assembly for an internal combustion engine of claim 1, the coolant baffle further comprising a positioning foot at a lower end thereof that is configured to stabilize the coolant baffle against movement when inserted into the water jacket.

10. The engine block assembly for an internal combustion engine of claim 1, the coolant baffle further comprising a positioning shelf located intermediate of a first end and a second end of the longitudinally extending seal body to locate and stabilize the coolant baffle against movement when inserted into the engine block.

11. The engine block assembly for an internal combustion engine of claim 1, the coolant baffle further comprising a scallop extending from a front side to the rear baffle face to define, when the coolant baffle is installed in the water jacket of the engine block, a coolant passage for the flow of engine coolant therethrough.

12. The engine block assembly for an internal combustion engine of claim 1, wherein the coolant baffle is constructed of a suitable heat resistant composite, a flexible rubberized material or a combination thereof.

13. An engine block assembly for an internal combustion engine comprising:

a closed deck cylinder portion having a plurality of cylinder walls disposed therein;

a water jacket, having opposed side walls, extending about the plurality of cylinder walls to define a coolant flow path around the cylinder walls;

a coolant inlet in fluid communication with the water jacket for delivery of coolant thereto;

a coolant outlet in fluid communication with the water jacket for removal of coolant from the water jacket;

first and second, opposed sealing shoulders extending into the coolant flow path of the water jacket from the water jacket side walls, the cooling shoulders extending the height of the water jacket;

an opening extending through the closed deck cylinder portion adjacent to the opposed sealing shoulders; and a longitudinally extending coolant baffle inserted into the water jacket through the opening in the closed deck cylinder portion, the coolant baffle having a baffle sealing face having first and second sealing surfaces configured to engage the opposed sealing shoulders to define a face seal therebetween and to close a portion of the water jacket against coolant flow and direct the flow of coolant entering the water jacket through the coolant inlet.

14. The engine block assembly for an internal combustion engine of claim 13, the longitudinally extending coolant baffle extending the substantially the height of the water jacket.

15. The engine block assembly for an internal combustion engine of claim 13, the longitudinally extending coolant baffle further comprising a positioning rib extending from the baffle sealing face between the opposed sealing shoulders of the water jacket side walls to locate the sealing surfaces in sealing engagement with the opposed sealing shoulders of the water jacket.

16. The engine block assembly for an internal combustion engine of claim 13, the coolant baffle further comprising a flexible retaining member disposed at an upper end thereof and configured to extend outwardly from the coolant baffle to engage an under-portion or lip of the engine block deck.

17. The engine block assembly for an internal combustion engine of claim 13, the coolant baffle further comprising a positioning foot at a lower end thereof that is configured to stabilize the coolant baffle against movement when inserted into the water jacket.

18. The engine block assembly for an internal combustion engine of claim 13, wherein the first and second sealing surfaces of the longitudinally extending seal body are independently configured to match the contours of the water jacket side sealing shoulders on either side of the water jacket.

19. The engine block assembly for an internal combustion engine of claim 18, wherein the independently configured first and second sealing surfaces of the longitudinally extending seal body include integrated mold inflection points.

* * * * *